United States Patent [19]

Nishiguchi

[11] Patent Number: 4,654,285

[45] Date of Patent: Mar. 31, 1987

[54] ELECTROPHOTOGRAPHIC SENSITIVE MEMBER SUITABLE FOR COHERENT BEAMS AND METHOD OF PRODUCING SAME

[75] Inventor: Yasuo Nishiguchi, Kagoshima, Japan

[73] Assignees: Kyocera Corporation, Kyoto; Takao Kawamura, Osaka, both of Japan

[21] Appl. No.: 655,931

[22] Filed: Sep. 28, 1984

[30] Foreign Application Priority Data

Sep. 29, 1983 [JP] Japan ..... 58-182432

[51] Int. Cl.[4] ..... G03G 5/14

[52] U.S. Cl. ..... 430/69; 430/84; 430/133

[58] Field of Search ..... 430/84, 95, 69, 133

[56] References Cited

U.S. PATENT DOCUMENTS 4,464,451 8/1984 Shirai et al. ..... 430/84

4,492,745 1/1985 Mimura et al. .

*Primary Examiner*—John L. Goodrow

*Attorney, Agent, or Firm*—Spensley Horn Jubas & Lubitz

[57] ABSTRACT

The present invention relates to an electrophotographic sensitive member for use in a laser line printer and a method of producing same.

10 Claims, 3 Drawing Figures

Fig. 1
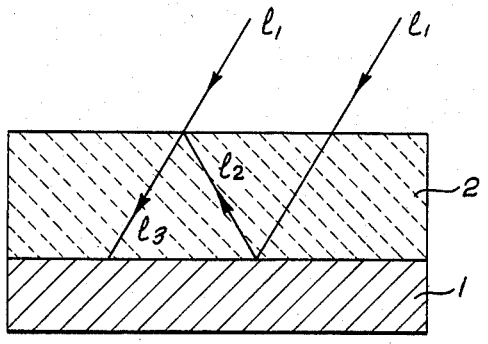
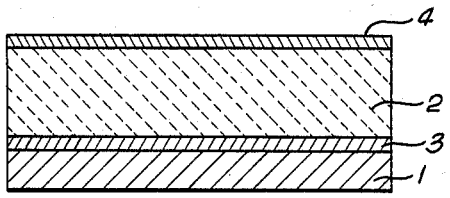
Fig. 2
Fig. 3
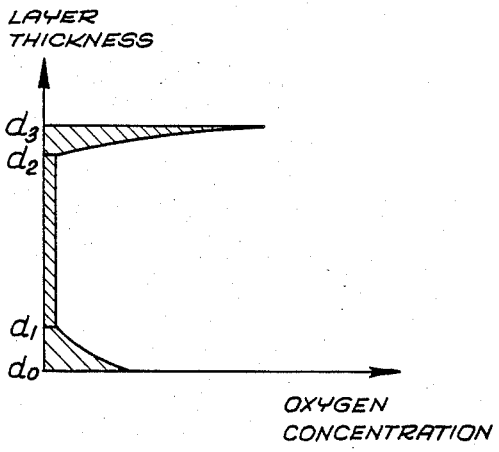

ELECTROPHOTOGRAPHIC SENSITIVE MEMBER SUITABLE FOR COHERENT BEAMS AND METHOD OF PRODUCING SAME

BACKGROUND OF THE INVENTION

Recently, a laser line printer, in which laser rays are used as recording members, has been used as a small-sized, light weight, low-electric power consumption, high-density and high-speed recording method. For example, a semiconductor laser printer and a photoelectric member mainly consisting of amorphous silicon for use in said semiconductor laser printer are being watched with interest. However, since laser rays are monochromatic, such a problem that a photosensitive member, in which an electrically conductive substrate is coated with a photoconductive layer, reflects a part of incident rays such as semiconductor laser rays from said electrically conductive substrate, a part of the reflected rays being reflected again from a photoconductive layer, an interference being produced between the twice reflected rays and incident rays to give a striped pattern to an electric charge latent image, whereby an interference fringe-like uneven distribution of concentration is produced on an image after the development thereof is pointed out.

The present invention aims at the solution of the above described problem and provides an electrophotographic sensitive member comprising an electrically conductive substrate coated with a photosensitive layer consisting of at least a photoconductive layer and receiving laser rays from the surface side thereof to produce photocarriers in said photoconductive layer, in which the interference being produced between the said twice reflected rays and incident rays can be reduced, whereby a striped pattern can be prevented from being produced on an image by selecting $a \times b$ of 0.2 or less, wherein the transmissivity of said laser rays through said photosensitive layer is a and the reflection factor of said laser rays by said substrate is b, and previously mirror-polishing the surface of said substrate so as to reach a surface roughness of 0.2 μm or less and then etching it so as to reach a surface roughness of 0.2 to 4 μm followed by coating said substrate with photosensitive layer.

1. Field of the Invention

The present invention relates to an electrophotographic sensitive member for use in a laser line printer and a method of producing same.

2. Prior Art

Recently, a laser line printer, in which laser rays are used as recording members, has been used as a small-sized, light weight, low-electric power consumption, high-density and high-speed recording method. For example, a semi-conductor laser printer and a photoelectric member, which is mainly formed of amorphous silicon (hereinafter referred to as a-Si), for use in said semiconductor laser printer are being watched with interest.

However, since said laser rays are monochromatic laser rays, which reached the inside of a photosensitive layer, are insufficiently absorbed by a photoconductive layer to reach an electrically conductive substrate carrying said photoconductive layer thereon and be reflected from the surface thereof, whereby leading to the following problem in many cases:

That is to say, a photosensitive member, in which an electrically conductive substrate 1 is coated with a photoconductive layer 2 as shown in FIG. 1, said electrically conductive substrate 1 reflects a part of incident rays $l_1$ such as semiconductor laser rays, a part of the reflected rays $l_2$ being reflected again from the surface of said photoconductive layer 2, the interference being produced between the twice reflected rays $l_3$ and said incident rays $l_1$ to give a striped pattern to an electric charge latent image, whereby an interference fringe-like uneven distribution of concentration is produced on an image after the development thereof.

SUMMARY OF THE INVENTION

The present invention was achieved with respect to the above-mentioned. Thus it is an object of the present invention to provide an electrophotographic sensitive member in which the interference being produced between the said twice reflected rays and incident rays can be reduced, whereby a striped pattern can be prevented from being produced on an image.

It is another object of the present invention to provide a method of producing an electrophotographic sensitive member in which a striped pattern can be prevented from being produced on an image.

The present invention is to provide an electrophotographic sensitive member comprising an electrically conductive substrate coated with a photosensitive layer consisting of at least a photoconductive layer and receiving laser rays from the surface side of said photosensitive layer to produce photocarriers in said photoconductive layer, characterized by that $a \times b$ of 0.2 or less, wherein a is the transmissivity of said laser rays through said photosensitive layer and b is the reflection factor of said laser rays by said substrate, is selected.

Furthermore, the present invention is to provide a method of producing an electrophotographic sensitive member comprising an electrically conductive substrate coated with a photosensitive layer consisting of at least a photoconductive layer and receiving laser rays from the surface side of said photosensitive layer to produce photocarriers in said photoconductive layer, characterized by that $a \times b$ of 0.2 or less, wherein a is the transmissivity of said laser rays through said photosensitive layer and b is the reflection factor of said laser rays by said substrate, is selected, characterized by that it consists of the following steps:

a step for previously mirror-polishing the surface of said substrate so as to reach the surface roughness of 0.2 μm or less;

a step for etching the surface of said substrate so as to reach the surface roughness of 0.2 to 4 μm; and a step for coating said substrate with said photosensitive layer.

DESCRIPTION OF THE DRAWINGS

The present invention will be in detail described below with reference to the drawings, in which FIG. 1 is a diagram showing a photosensitive member producing an interference;

FIG. 2 is an enlarged sectional view showing a photosensitive member according to the present invention; and FIG. 3 is a schematic view showing the distribution of oxygen concentration along the thickness of a photosensitive member according to the present invention.

DETAILED DESCRIPTION OF THE INVENTION

The above described objects of the present invention can be efficiently attained by selecting a×b of 0.2 or less in cases where a substrate having the reflection factor of laser rays of b is coated with a photosensitive layer having the transmissivity a of said laser rays therethrough for various kinds of photosensitive member such as a laminated layer type photosensitive member comprising a barrier layer, a surface protection layer and the like, which will be described later, together with a photoconductive layer and a photosensitive member using a substrate formed of materials such as aluminium.

It was found that if the value of a×b exceeded 0.2, a bad influence of a striped pattern upon the image quality required for photosensitive members for use in a laser line printer could be almost disregarded, whereby such photosensitive member could be satisfactorily used in practice, and further if the value of a×b was preferably 0.1 or less, a striped pattern could not be confirmed with the naked eye, whereby a remarkably excellent image could be obtained. In this time, the transmissivity a shows a rate of the strength of laser rays, which passed through a photosensitive layer to the strength of said laser rays incident upon a photosensitive member.

In addition, the present inventor found that the reflection factor of laser rays by a substrate could be specified by mirror-polishing and then etching said substrate so as to reach the appointed range of surface roughness.

That is to say, a material pipe for producing a drum-like aluminium substrate is mirror-polished by means of an ultra-precision lathe using a diamond bit and the like so as to reach the surface roughness of preferably 0.2 μm or less. If the surface roughness exceeds 0.2 μm, a striped pattern, which was produced in the circumferential direction of a drum in the mirror-polishing process, is exaggerated in the subsequent etching process to form an unevenly roughened surface, whereby the use of a photosensitive member comprising such a substrate leads to the production of a striped pattern on a copied image.

Such an aluminium substrate mirror-polished so as to reach the surface roughness of 0.2 μm or less has acute angular uneven portions, which were partially produced on the surface thereof in the mirror-polished process. Accordingly, the use of a photosensitive member comprising such a substrate leads to the formation of a partially whitened image due to the above described projection-like defects.

Consequently, when said acute angular uneven portions are made smooth by etching so as to reach the surface roughness of 0.2 to 4 μm, the reflection factor of laser rays by a substrate can be remarkably reduced, particularly in cases of laser rays having transmission wave lengths of 400 to 850 nm. In addition, if the surface roughness is smaller than 0.2 μm, in cases where an aluminium substrate is coated with an a-Si photosensitive layer, large projections having a size of several ten μm are formed with minute projections on the surface of a substrate as nuclei, whereby partially whitened portions are formed on an image or the disadvantage such as insufficient cleaning come out. On the contrary, if the surface roughness is larger than 4 μm, the problems such as the reduction of charged voltage, the reduction of image concentration, insufficient cleaning of toner and the like are liable to come out.

Either the wet etching or the dry etching may be used for said etching treatment. In the wet etching process, the above described effects can be attained by using chemical etching agents such as phosphoric acid-sulfuric acid type one, phosphoric acid-nitric acid type one, phosphoric acid-sulfuric acid-nitric acid type one and nitric acid-fluoric acid type one. In the dry etching process, the mirror-polished substrate is subjected to a plasma-etching treatment in a glow-discharge decomposition apparatus for forming a photosensitive layer, into which at first gases for use in plasma-etching such as $CCl_4$, $BCl_4$ and $CF_4$ and hydrogen gas are introduced and subsequently gases for forming a photosensitive layer are introduced, to form a photosensitive layer, whereby the photoelectric characteristics of a photosensitive layer can be brought into full play, the production yield of photosensitive layers being improved, and the operation efficiency being able to be increased since a substrate is not exposed to an air and it can be prevented from being oxidized and contaminated.

Further, although minute stocks of aluminium adhered to the surface of an aluminium substrate in the mirror-polishing process can be difficultly removed by cleaning, a substrate, from which they were completely removed, can be obtained in this dry etching process.

An electrophotographic sensitive member according to the present invention can be used for various kinds of recording member having transmission wave lengths of 400 to 850 nm such as He-Ne gas laser rays having transmission wave lengths of about 633 nm and He-Cd gas laser rays having transmission wave lengths of about 442 nm. For example, an electrophotographic sensitive member comprising an a-Si photoconductive layer showing excellent photosensitive characteristics in a near-infrared region having transmission wave lengths of about 800 nm can be suitably used for recording members having transmission wave lengths larger than 700 nm, for example in a laser line printer using semiconductor laser rays having transmission wave lengths of 750 to 800 nm as recording members.

Thus, according to an electrophotographic sensitive member for use in a laser line printer according to the present invention, a striped pattern due to laser rays could be prevented from being produced on an image by selecting a×b of 0.2 or less, wherein a is the transmissivity of laser rays through a photosensitive layer formed on a substrate and b is the reflection factor of laser rays by a substrate.

Furthermore, according to a method of producing an electrophotographic sensitive member according to the present invention, since the reflection factor of laser rays by a substrate b is reduced by preliminarily mirror-polishing a substrate material so as to reach the surface roughness of 0.2 μm or less and then etching it so as to reach the surface roughness of 0.2 to 4 μm, a striped pattern can be prevented from being produced on the surface of a substrate; in addition, an electrophotographic sensitive member having stabilized operation characteristics can be obtained since the surface of a substrate can be sufficiently cleaned by this etching process.

Then an a-Si photosensitive member, which was proposed by the present inventor before, to be used in Examples described later will be described.

As shown in FIG. 2, this photosensitive member comprises a photosensitive layer formed of laminated barrier layer 3, photoconductive layer 2 and surface protective layer 4 on an electrically conductive substrate 1 and is characterized by that each of said layers is formed of an a-Si. The composition and thickness of said layers are shown in Table 1.

TABLE 1

| Kind of layer | Thickness of layer (μm) | Content Oxygen (atomic %) | Hydrogen (atomic %) | Boron (atomic %) |
|---|---|---|---|---|
| Surface protective layer (4) | 0.05~1.0 | described later | 10~40 | 0~20000 |
| Photoconductive layer (2) | 5~100 | $10^{-5}$~ $5 \times 10^{-2}$ | 10~40 | 10~20000 |
| Barrier layer (3) | 0.2~5.0 | described later | 10~40 | 50~500 |

It is desirable that the oxygen content in a barrier layer 3 is 0.1 to 20.0 atomic % at the beginning of the formation thereof and then gradually reduced during the formation thereof, preferably until the same value as that in said photoconductive layer 2 at the finish of the formation of said barrier layer 3.

In addition, it is desirable that the oxygen content in a surface protective layer 4 is gradually increased during the formation of said surface protective layer 4 until 1.0 to 60.0 atomic % at the finish of the formation of said surface protective layer 4, preferably it being same as that in said photoconductive layer 2 at the beginning of the formation of said surface protective layer 4.

Such an a-Si photosensitive member has remarkably large charge-retentivity and is characterized by small darkness-attenuation speed, whereby showing remarkably improved photosensitivity to near-infrared rays.

In addition, the residual voltage can be reduced to almost zero by gradually reducing the oxygen-content in a barrier layer from the maximum value at the boundary surface of said barrier layer and a substrate.

The Examples, in which the above described a-Si photosensitive member having excellent photoelectric characteristics is used in a laser line printer using semiconductor laser rays having trasmission wave lengths of 770 to 780 nm as recording members, will be described below.

EXAMPLE 1

An aluminium drum mirror-polished with surface roughness of 0.02 μm by means of an ultra-precision lathe using a diamond bit is cleaned by degreasing with alkalis, washing and drying and then etched in an etching solution (phosphoric acid:nitric acid:acetic acid:water=13:1:2:1) for 3 minutes at 50° C.

After etching, it is washed and dried again to obtain an aluminium substrate 1 without being coated with layers.

The resulting substrate 1 has the surface roughness of 1.2 μm and the reflection factor of about 5% measured for semiconductor rays having a transmission wave length of 770 nm.

Then said barrier layer 3 is formed on said aluminium substrate 1 in a glow-discharge decomposition apparatus, in which the oxygen-content is gradually and continuously decreased from the composition consisting of oxygen of about 5.0 atomic %, boron of about 200 ppm and hydrogen of about 10 atomic % so that oxygen of about 0.02 atomic %, boron of about 200 ppm and hydrogen of about 15 atomic % may be contained at the thickness of 2.0 μm. Then a photoconductive layer 2 of the same composition as a finally formed barrier layer, the said layer 2 having the thickness of 21.8 μm, is formed on the finally formed barrier layer.

Further, a surface protective layer 4, in which the boron-content is gradually and continuously decreased while the oxygen-content is gradually and continuously increased so that oxygen may be contained at a ratio of about 50 atomic %, hydrogen being contained at a ratio of about 15 atomic %, and boron being not contained at the outside surface of a photosensitive layer, is formed in the thickness of 0.2 μm.

The outline of the distribution of oxygen-concentration in a laminated layer type photosensitive member produced in the above described manner is shown in FIG. 3.

Referring to FIG. 3, an axis of abscissa indicates concentrations of oxygen and an axis of ordinate indicates a thickness of said barrier layer 3 in a range of $d_0$–$d_1$, a thickness of said photoconductive layer 2 in a range of $d_1$ to $d_2$ and a thickness of said surface protective layer 4 in a range of $d_2$ to $d_3$, respectively.

Thus obtained a-Si photosensitive member has remarkably large charge-retentivity and is characterized by small darkness-attenuation speed, whereby showing remarkably improved photosensitivity to near-infrared rays. It was confirmed that when thus obtained a-Si photosensitive member was used in a semiconductor laser printer (wave length of 770 nm, printing speed of 20 pieces/min), a striped pattern was not produced, images having high dissolution and contrast, images having high quality being obtained, the deterioration such as the decrease in concentration, the fogging of a white ground and the whitening due to defects on the drum surface being not found at all even after the repeated tests of 300,000 times, and it being very highly durable.

EXAMPLE 2

Photosensitive members (A) to (G) as shown in Table 2 having various kinds of surface roughness were obtained in the same manner as in Example 1 excepting etching times.

TABLE 2

| Photosensitive member | Surface roughness of a substrate (μm) | Reflection factor of a substrate | Transmissivity of laser rays through a photosensitive layer × reflection factor of laser rays by a substrate | Evaluation of images |
|---|---|---|---|---|
| A* | 0.05 | 0.92 | 0.24 | X |
| B* | 0.1 | 0.90 | 0.23 | X |
| C | 0.3 | 0.68 | 0.18 | |
| D | 1.4 | 0.07 | 0.02 | |
| E | 3.0 | 0.03 | 0.008 | |
| F | 4.5 | 0.07 | 0.02 | Δ |
| G | 7.0 | 0.1 | 0.03 | Δ |

*mark indicates a photosensitive member outside the scope of the present invention.

Also the values of (the reflection factor of semiconductor laser rays having transmission wave lengths of 770 to 780 nm by an aluminium substrate used in said photosensitive members (A) to (G))×(the transmissivity of semiconductor laser rays (0.26) through a photosensitive layer) were shown in Table 2. The evaluation of images was carried out under the condition that said photosensitive members (A) to (G) were used in a laser line printer using said laser rays as recording members.

mark indicates that a striped pattern is not found with the naked eye at all, mark indicating that a bad influence of a striped pattern upon the quality of images required for photosensitive members for use in a laser line printer can be almost disregarded, whereby any hindrance is not provided with respect to practical use, Δ mark indicating that although a bad influence of a striped pattern can be almost disregarded, the reduction of charged voltage, the reduction of image concentration, insufficient cleaning of toner and the like are found, whereby images of good quality can not be obtained, and X mark indicating that the reduction of charged voltage, the reduction of image concentration, insufficient cleaning of toner and the like are found in addition to a striped pattern prodced on images, whereby bad images are obtained.

As obvious from Table 2, photosensitive members (C) to (E) can be satisfactorily used in practice. In cases where photosensitive members (C) to (E) are used, an influence by a striped pattern can be disregarded, in particular in cases where photosensitive members (D), (E) are used, good images without having slightest striped pattern can be obtained. In cases where photosensitive members (F), (G) are used, the problem of a striped pattern can be solved but good images can not be obtained due to insufficient cleaning and the like. In cases where photosensitive members (A), (B) are used, a striped pattern is distinctly found on images together with insufficient cleaning and the like, whereby they can not be practically used.

EXAMPLE 3

Aluminium substrate having various kinds of surface roughness and reflection factor were obtained in the same manner as in Example 1 and Example 2 and then a laminated type a-Si photosensitive layer, in which the composition and thickness of each layer were specified as shown in Table 1 and which had various kinds of transmissivity, was formed on said aluminium substrates to obtain photosensitive members (H), to (P) as shown in Table 3. The evaluation of images was carried out under the condition that said photosensitive members (H) to (P) were used in a laser line printer using semiconductor laser rays having a transmission wave length of 770 nm as recording members. The results are shown in Table 3.

TABLE 3

| Photosensitive member | Surface roughness of a substrate (μm) | Reflection factor of a substrate | Transmissivity of laser rays through a photosensitive layer | Transmissivity of laser rays through a photosensitive layer × Reflection factor of laser rays by a substrate | Evaluation of images |
|---|---|---|---|---|---|
| H* | 0.05 | 0.92 | 0.34 | 0.31 | X |
| I | 0.3 | 0.68 | 0.19 | 0.13 | |
| J | 0.3 | 0.68 | 0.10 | 0.07 | |
| K | 0.5 | 0.65 | 0.19 | 0.12 | |
| L | 0.5 | 0.65 | 0.10 | 0.07 | |
| M | 1.2 | 0.07 | 0.34 | 0.02 | |
| N | 3.0 | 0.03 | 0.21 | 0.01 | |
| O | 4.5 | 0.07 | 0.19 | 0.01 | Δ |
| P | 7.0 | 0.1 | 0.19 | 0.02 | Δ |

*mark indicates a photosensitive member outside the scope of the present invention.

As obvious from Table 3, in cases where photosensitive members (I) to (N) are used, an influence by a striped pattern produced on images can be disregarded such an extent that they can be satisfactorily used in practice, in particular in cases where photosensitive members (J), (L), (M) and (N) are used, good images without having slightly striped pattern can be obtained. In cases where photosensitive members (O), (P) are used, the problem of a striped pattern can be solved but good images can not be obtained due to insufficient cleaning and the like. In cases where photosensitive member (H) is used, a striped pattern is distinctly found on images together with insufficient cleaning and the like, whereby it can not be practically used.

Further, in cases where photosensitive members (I), (J), in which the reflection factor of a substrate is large but the transmissivity of photosensitive layer is small, or photosensitive members (M), (N), in which the transmissivity of a photosensitive layer is large but the reflection factor of a substrate is small, are used, a striped pattern can be prevented from being produced on images.

As above described, when an electrophotographic sensitive member for use in a laser printer according to the present invention is used, good images without having slightest striped pattern can be obtained by specifying the product of the transmissivity of laser rays through a photosensitive layer by the reflection factor of laser rays by a substrate. In addition, not only a striped pattern can be prevented from being produced on images but also the problems such as the reduction of charged voltage, the reduction of image concentration, insufficient cleaning of toner and the like can be solved by selecting the surface roughness of a substrate connected with the reflection factor thereof within the appointed region.

What is claimed is:

1. A method of producing an electrophotographic sensitive member in which the interference produced between twice reflected rays and incident rays may be reduced, whereby a striped pattern may be prevented from being produced on an image formed by a laser printer, said member comprising an electrically conductive substrate coated with a photosensitive layer consisting of at least a photoconductive layer and receiving laser rays from the surface side of said photosensitive layer to produce photocarriers in said photoconductive layer, wherein the product of $a \times b$ is 0.2 or less, where a is the transmissivity of said laser rays through said photosensitive layer and b is the reflection factor of said laser rays by said substrate, said method comprising the following steps:

previously mirror-polishing the surface of said substrate so as to reach the surface roughness of 0.2 μm or less;

etching the surface of said substrate so as to reach the surface roughness of 0.2 to 4 μm; and coating said substrate with said photosensitive layer.

2. A method of producing an electrophotographic sensitive member as set forth in claim 1, characterized by that said photosensitive layer is mainly formed of amorphous silicon.

3. A method of producing an electrophotographic sensitive member as set forth in claim 1, characterized by that said substrate is mainly formed of aluminium.

4. A method of producing an electrophotographic sensitive member as set forth in claim 1, characterized by that the transmission wave lengths of said laser rays are within a range of 400 to 850 nm.

5. An electrophotographic sensitive member in which the interference produced between twice reflected rays and incident rays may be reduced, whereby a striped pattern may be prevented from being produced on an image formed by a laser line printer of the type having a recording member having transmission wave lengths of 400–850 nm, the electrophotographic sensitive member comprising:

a conductive substrate having a major surface, the roughness of the major surface ranging from about 0.2 m to about 4.0 m, the conductive substrate major surface having a reflection factor of b;

an amorphous silicon photosensitive layer intimately contacting the major surface of the conductive substrate, the transmissivity of the laser through the photosensitive layer being a, wherein the conductive substrate and photosensitive layer are selected such that the product of a and b is less than or equal to 0.2.

6. An electrophotographic sensitive member according to claim 5 wherein the photosensitive layer consists of a barrier layer interfacing a photoconductive layer and a surface protective layer.

7. An electrophotographic sensitive member according to claim 6 wherein each of the layers constituting the photosensitive layer contains oxygen and wherein the amount of oxygen in the portion of the barrier layer adjacent the interface between the barrier layer and the conductive substrate ranges from about 0.1 to about 20.0 atomic percent.

8. A method of forming an electrophotographic sensitive member in which the interference produced between twice reflected rays and incident rays may be reduced, whereby a striped pattern may be prevented from being produced on an image formed by a laser line printer of the type having a recording member having transmission wave lengths of 400 to 850 nm, the method comprising the steps of:

(a) treating a major surface of a conductive substrate such that the surface roughness of the major surface is 0.2 m or less;

(b) treating the major surface resulting from step (a) so as to reach a surface roughness ranging from 0.2 to 4.0 m; and (c) forming a photosensitive layer on the major surface resulting from step (b) so that the product of a and b is 0.2 or less, where a is the transmissivity of the laser through the photosensitive layer and where b is the reflection factor of the conductive substrate major surface.

9. A method according to claim 8 wherein the treatment step (a) comprises polishing the major surface.

10. A method according to claim 8 wherein the treatment step (b) comprises etching with an aqueous etching solution comprising phosphoric acid, nitric acid and acetic acid.

* * * * *